US007481580B2

(12) United States Patent
Schreiter

(10) Patent No.: US 7,481,580 B2
(45) Date of Patent: Jan. 27, 2009

(54) RECLOSABLE FLEXIBLE PACKAGE WITH DISPLACEABLE TAMPER-EVIDENT STRUCTURE

(75) Inventor: Michael E. Schreiter, Appleton, WI (US)

(73) Assignee: Reynolds Consumer Products, Inc., Richmond, VA (US)

( * ) Notice: Subject to any disclaimer, the term of this patent is extended or adjusted under 35 U.S.C. 154(b) by 701 days.

(21) Appl. No.: 10/957,040

(22) Filed: Oct. 1, 2004

(65) Prior Publication Data

US 2006/0072854 A1 Apr. 6, 2006

(51) Int. Cl.
*B65D 33/14* (2006.01)
*B65D 33/00* (2006.01)
*B65D 33/16* (2006.01)

(52) U.S. Cl. ..... 383/5; 383/203; 383/61.2; 383/66

(58) Field of Classification Search ..... 383/5, 383/203, 205, 61.3, 61.2, 66
See application file for complete search history.

(56) References Cited

U.S. PATENT DOCUMENTS 3,301,391 A * 1/1967 Guyer ..... 206/362
3,790,992 A 2/1974 Herz
4,290,467 A * 9/1981 Schmidt ..... 383/9
4,615,045 A 9/1986 Siegel
4,744,674 A 5/1988 Nocek
4,786,190 A 11/1988 Van Erden et al.
4,832,505 A 5/1989 Ausnit et al.
4,923,309 A 5/1990 Van Erden
4,925,316 A 5/1990 Van Erden et al.
5,005,707 A 4/1991 Hustad et al.
5,121,997 A 6/1992 La Pierre et al.
5,456,928 A 10/1995 Hustad et al.
5,480,230 A 1/1996 May
5,488,807 A 2/1996 Terrenzio et al.
5,577,612 A * 11/1996 Chesson et al. ..... 206/494
5,669,715 A 9/1997 Dobreski et al.
5,911,508 A 6/1999 Dobreski et al.
5,927,855 A 7/1999 Tomic et al.
6,000,197 A 12/1999 Ausnit
6,004,032 A 12/1999 Kapperman et al.
6,010,244 A 1/2000 Dobreski et al.
6,131,369 A 10/2000 Ausnit
6,212,857 B1 4/2001 Van Erden
6,273,607 B1 * 8/2001 Buchman ..... 383/5
6,287,001 B1 9/2001 Buchman
6,290,390 B1 * 9/2001 Buchman ..... 383/5
6,290,391 B1 * 9/2001 Buchman ..... 383/5
6,293,701 B1 9/2001 Tomic
6,293,896 B1 9/2001 Buchman (Continued)

*Primary Examiner*—Jes F Pascua
(74) *Attorney, Agent, or Firm*—Merchant & Gould P.C.

(57) ABSTRACT

A reclosable package includes first and second side panels connected to each other along respective side edges and bottom edges. A zipper closure is secured to the first and second side panels along upper edges thereof. A slider device is operably mounted on the zipper closure for opening and closing the zipper closure and a tamper-evident header is connected to the zipper closure and surrounds the slider device. The tamper-evident header has a front portion and a rear portion with upper ends connected together above the slider device and lower ends connected to the zipper closure. The front portion includes a segment displaceable therefrom to allow access to the slider device. A rear portion of the header may be formed with a hole for suspending or carrying the package.

7 Claims, 7 Drawing Sheets

U.S. PATENT DOCUMENTS 6,357,914 B1 3/2002 Kinigakis et al.
6,364,530 B1 4/2002 Buchman
6,474,866 B2 * 11/2002 Buchman ..... 383/5
6,572,266 B2 * 6/2003 Buchman ..... 383/5
6,609,828 B2 * 8/2003 Schneider et al. ..... 383/204
D484,040 S * 12/2003 Kinigakis et al. ..... D9/709
6,786,640 B2 * 9/2004 Schneider et al. ..... 383/5
6,910,806 B2 * 6/2005 Strand et al. ..... 383/61.2
7,341,160 B2 * 3/2008 Cappel et al. ..... 220/315
7,364,362 B2 * 4/2008 Schneider et al. ..... 383/61.2
2003/0002753 A1 * 1/2003 Stolmeier et al. ..... 383/64
2003/0044093 A1 * 3/2003 Schneider et al. ..... 383/5

* cited by examiner

RECLOSABLE FLEXIBLE PACKAGE WITH DISPLACEABLE TAMPER-EVIDENT STRUCTURE

FIELD OF THE INVENTION

The present invention relates generally to reclosable, fillable packages, and more particularly, pertains to resealable, flexible packages with slider devices and displaceable tamper-evident structure.

BACKGROUND OF THE INVENTION

In many consumer packaging applications, goods that are not used completely when the packages are initially opened rely on a zipper closure having locking first and second profiles to reclose the package and keep the remaining contents fresh. Examples of consumable goods that are often enclosed in packages with a zipper closure include pet food, medical supplies, fertilizers and many different foods edible by humans. The zipper closure is often combined with a slider device to facilitate opening and closing of the zipper closure back and forth across the width of the package. In some applications, a tamper-evident structure is included on the package to signify whether access has been gained to the zipper closure.

In addition to the desirable packaging characteristics described above, from the perspective of a retailer, manufacturer and/or customer, it is also important to provide means for effectively displaying and/or handling a product. To this end, hang holes in the top of the product package may be utilized to permit vertical display and/or enable convenient carrying of the package.

There remains a need for further developments in providing a reclosable packaging construction requiring limited accessibility to a combined slider and zipper closure as well as display and transport capability.

SUMMARY OF THE INVENTION

It is one object of the present invention to provide an improved reclosable package with a tamper-evident header which makes it easier to access a combined slider device and zipper closure.

It is also an object of the present invention to provide an improved reclosable package having a tamper-evident header which enables the package to be conveniently hung from a support or carried by a consumer.

The present invention is directed to a reclosable package having first and second opposed side panels connected to each other along respective side edges and bottom edges. A zipper closure is secured to the first and second side panels along upper edges thereof. The zipper closure extends from one of the sealed side edges to the other of the sealed side edges. A slider device is operably mounted on the zipper closure for opening and closing the zipper closure. A tamper-evident header is connected to the zipper closure and surrounds the slider device. As an improvement, the tamper-evident header includes a segment displaceable therefrom for accessing the slider device. The segment is preferably a strip which is at least partially severable from the header. The tamper-evident header is further provided with a hole permitting the package to be hung or carried. In one embodiment, the segment is completely removable from the header. In a further embodiment, the header has a first header portion and a second header portion opposite the first header portion with the segment being displaceable from one of the header portions and tucked between the slider device and the other of the header portions.

In another aspect of the invention, a reclosable package includes first and second side panels, each having an upper edge, opposed side edges and a bottom edge. The opposed side edges and the bottom edges are sealed together. A zipper closure is sealed to the first and second side panels along the upper edges thereof. The zipper closure extends from one of the sealed side edges to the other of the sealed side edges. A slider device is operably mounted on the zipper closure for opening and closing the zipper closure. A tamper-evident header is connected to the zipper closure and surrounds the slider device. The tamper-evident header has a front portion and a rear portion with upper ends connected together above the slider device and lower ends connected to the zipper closure. The front portion includes a segment displaceable therefrom to allow access to the slider device. The front portion and rear portions may also be referred to as the front face and rear face respectively. The terms are intended to be interchangeable and neither is ascribed a broader or narrower meaning than the other.

The segment is preferably a strip extending substantially entirely across the front portion between the sealed side edges of the side panels. The segment has one edge which is unattached to the front portion of the header. The segment has other edges connected to the front portion of the header by perforated or scored lines. The rear portion of the header may be formed with an opening used to suspend or carry the package.

In one embodiment the segment has upper and lower edges and a first side edge which are perforated, and a second side edge which lies free relative to the front portion of the header. The segment is completely removable from the front portion of the header.

In another embodiment, the segment has an upper edge permanently connected to the front portion of the header opposite side edges which are perforated, and a bottom edge lying free relative to the front portion of the header. The segment is displaceable between the slider device and the rear portion of the header.

The present invention also contemplates a method for preventing and enabling access to a reclosable package. The method includes the steps of providing first and second opposed panels connected to each other along respective side edges and bottom edges, a zipper closure being connected to the first and second side panels along upper edges thereof, and a slider device being operably mounted to the zipper closure for permitting opening and closing thereof; connecting a tamper-evident header to the zipper closure surrounding the slider device for normally preventing access thereto, the tamper-evident header including at least a partially severable segment; and at least partially severing the segment from the tamper-evident header so as to displace the segment and allow access to the slider device for opening and closing a package. The partially severable segment may also be referred to as a partially-removable segment. The terms are intended to be interchangeable and neither is ascribed a broader or narrower meaning than the other.

In carrying out such method, the tamper-evident header includes a front portion and a rear portion having upper ends joined together above the slider device and lower ends connected to the zipper closure. The segment is formed in the front portion of the header. A hole is formed in the rear portion of the header to enable hanging or carrying of the package. The segment is either completely removable from the front portion of the header, or is partially severed from the front portion of the header and inserted between the slider device and the rear portion of the header.

Various other objects, features and advantages of the invention will be made apparent from the following description taken together with the drawings.

BRIEF DESCRIPTION OF THE DRAWINGS

The drawings illustrate the best mode presently contemplated of carrying out the invention.

DETAILED DESCRIPTION OF THE INVENTION

The addition of tamper-evident structure to a flexible, fillable package, such as a bag, is advantageous in enabling the package to be secured so that the contents will not be prematurely contaminated and, in the case of food, will be kept fresh. The product described herein installs a tamper-evident structure to bags in a manner which also enhances the usefulness of the bag as a display or carried item.

Figure 1A:
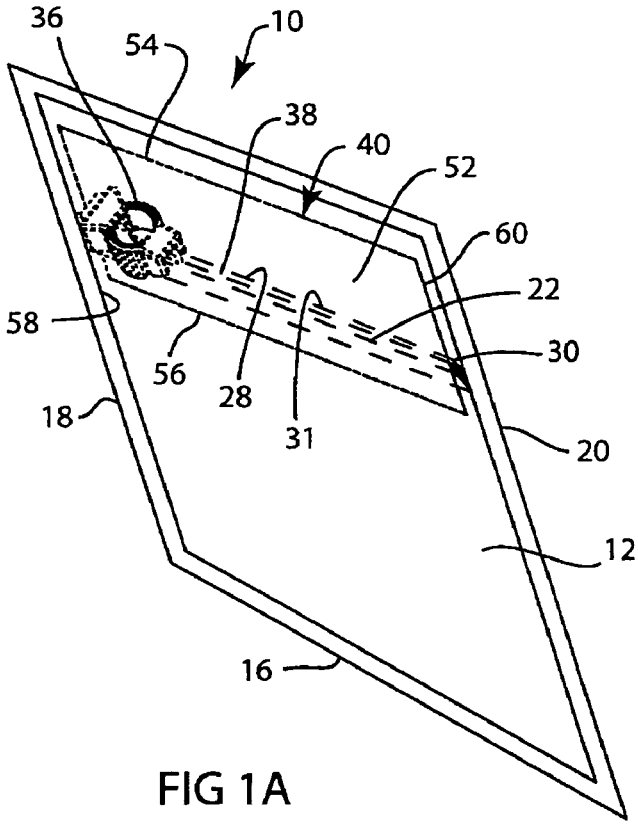
FIG. 1A is a perspective view of a flexible package having a slider device, a zipper closure and a partial tear-off header strip.

A flexible reclosable package 10 has opposing side panels 12, 14 (FIG. 5) that are joined to each other along a bottom wall 16 as shown in FIG. 1A. Side panels 12, 14 are sealed together at side seams 18, 20. A zipper closure arrangement having mating profiles to open (unseal and reseal) the package 10 is shown at 22. The zipper closure 22 can be formed in a variety of configurations. The zipper closure 22 includes a first mating profile 24 (FIG. 5) and a second mating profile 26 (FIG. 5) that engage and disengage, as appropriate, to open and close package 10. Zipper closure 26 extends from first edge 28 of package 10 to a second edge 30 cross a mouth 31. First and second profiles 24, 26 have respective first and second flanges 32, 34 (FIG. 5) depending therefrom which are sealed to upper edges of the panels 12, 14.

A slider device 36 is mounted on the zipper closure 22 to facilitate opening and closing of zipper closure 22. Slider devices and how they function to open and close zipper closures in general are taught in U.S. Pat. Nos. 5,063,644; 5,301,394; and 5,664,220, each of which is incorporated by reference. A notch 38 (FIG. 3A) is shown disposed within zipper closure 22 adjacent the edge 28 in package 10. The notch 38 is designed to provide a "park place" into which slider device 36 settles when zipper closure 22 is sealed, and slider device 36 is at the first edge 26 as seen in FIG. 1A. Such notch 38 decreases any tendency for an incomplete interlock between first mating profile 24 and second mating profile 26.

FIG 1A illustrates a partially removable, tear-off, tamper-evident header 40 disposed over slider device 36. By tamper-evident, it is meant that it provides an indication to the consumer as to whether the package 10 has been previously opened. In this embodiment, the tamper-evident header 40 covers and forms a hooded enclosure around the zipper closure 22 and slider device 36.

Figure 5:
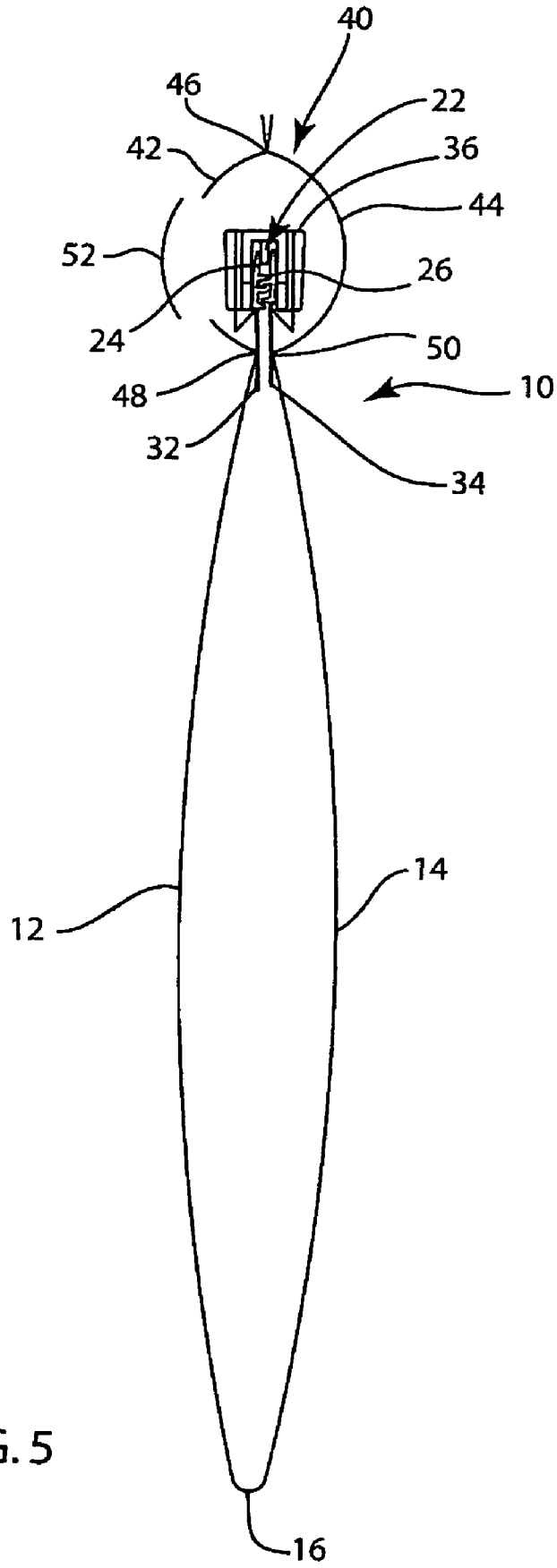
FIG. 5 is a sectional view of FIG. 1A showing removal of the partial tear-off header strip.

Referring to FIG. 5, the header 40 includes a front portion 42 and a rear portion 44 having upper ends sealed together at 46 and lower ends sealed to the flanges 32, 34 at 48, 50. As best seen in FIG. 1A, the front portion 42 of header 40 has a displaceable, removable strip 52 having perforated or scored lines along an upper edge 54, a lower edge 56 and a vertical side edge 58 adjacent package first edge 28. The opposite vertical side edge 60 adjacent package second edge 30 is left unattached to the front portion 42 of header 40. It should be understood that the displaceable strip 52 may be otherwise partially attached along its edges to the front portion 42 of the header 40 as will be described hereafter.

Figure 2:
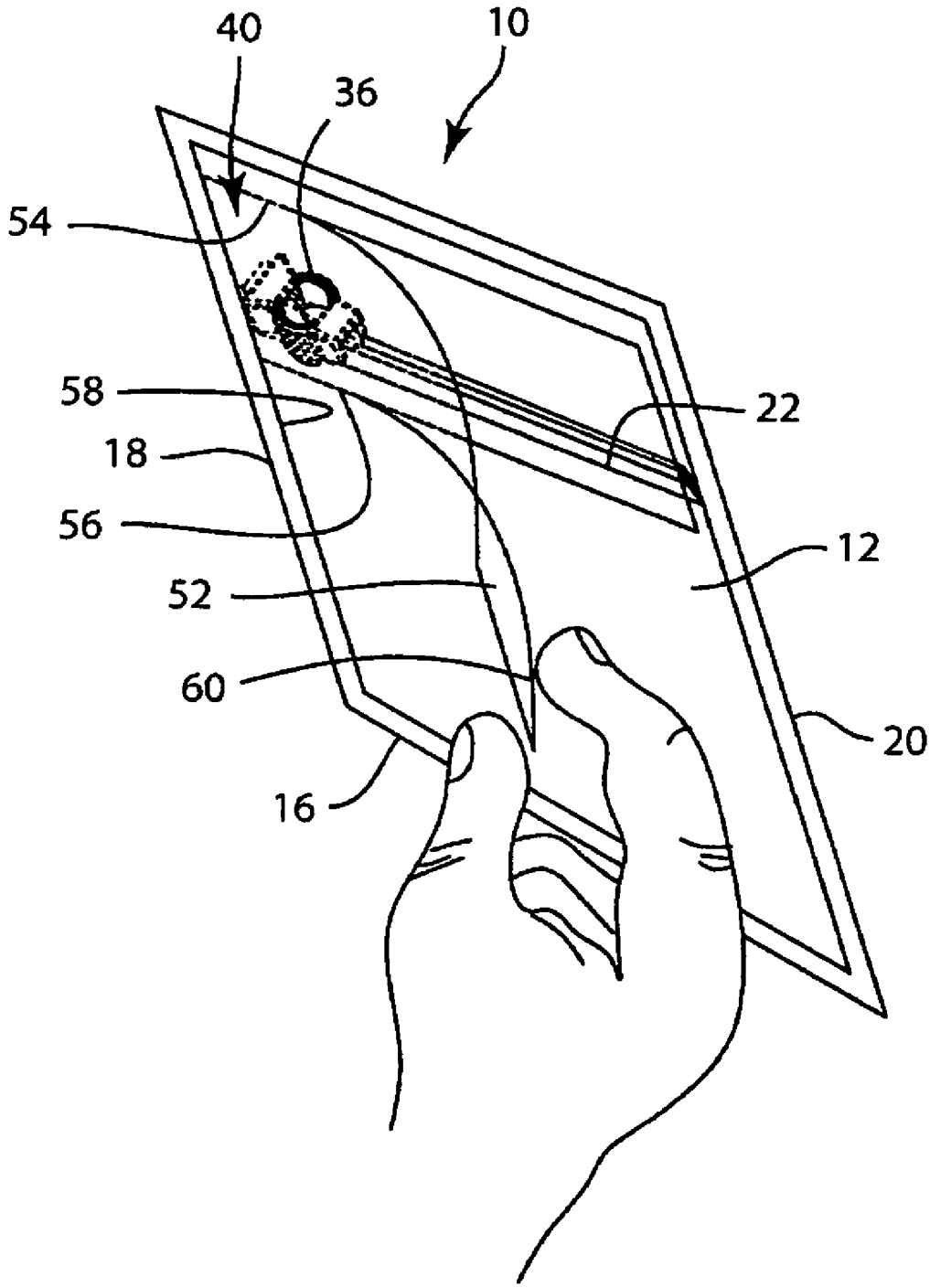
FIG. 2 is a perspective view showing removal of the partial tear-off header strip of FIG. 1A.

In order to access the interior of package 10 and slider device 36 for the first time, the strip 52 of tamper-evident header 40 needs to be displaced and, in this case, removed. As depicted in FIG. 2, to remove the strip 52, a consumer typically accesses and grasps the free edge 60 between his/her thumb and forefinger and pulls the strip 52 horizontally towards package first edge 28 severing the strip 52 along respective upper and lower edges 54, 56. A further pulling force downwardly separates the vertical edge 58 so that the strip 52 is completely removed from header front portion 42.

Figure 3A:
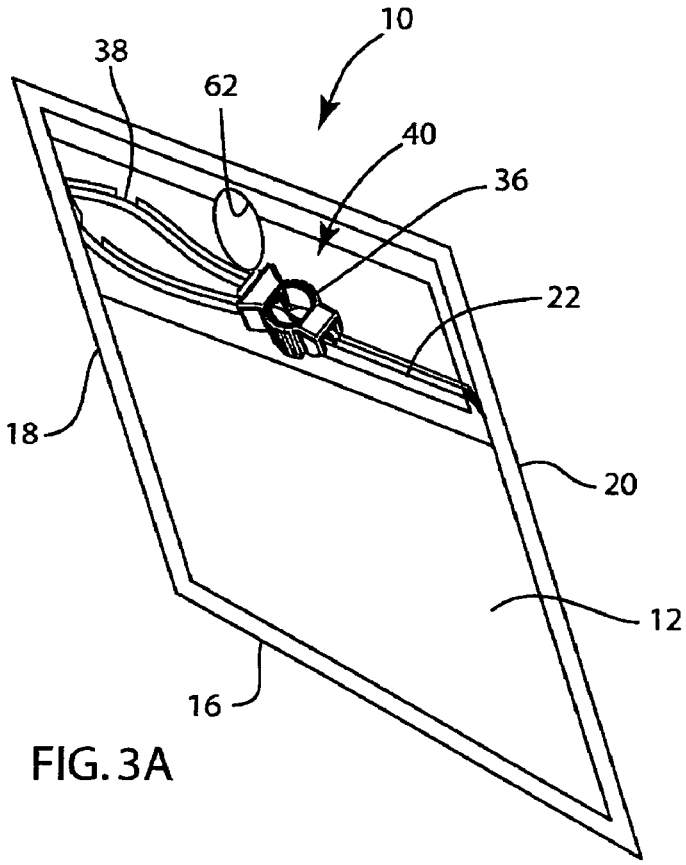
FIG. 3A is a perspective view of the flexible package in FIG. 2 with the partial tear-off header strip removed and a remaining header portion provided with a hole for suspending the package.
Figure 3B:
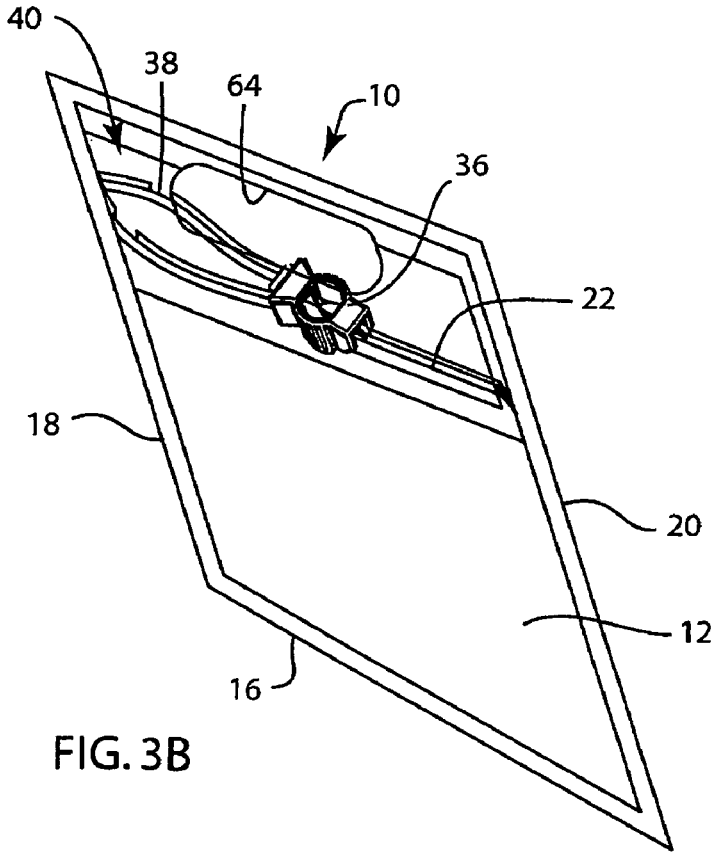
FIG. 3B is a view like FIG. 3A but showing the remaining header portion with a hand-receiving opening so that the remaining header portion defines a handle.

At this point, the slider device 36 may be moved back and forth across the zipper closure 22 as shown in FIG. 3A to selectively open and close the package 10. As a feature of the invention, the remaining rear portion 44 of header 40 which extends over and above the slider device 36, may be provided with a hang hole 62 centrally located in the top, mid-portion thereof. The hang hole 62 conveniently permits the package 10 to be vertically displayed from a support rod, bracket or the like before and/or after the strip 52 has been removed. Alternatively, as illustrated in FIG. 3B, the rear portion 44 of header 40 may be formed with an enlarged, elongated opening 64 sized to receive a consumer's fingers so that the rear portion 44 will define a handle for carrying the package 10.

Figure 1B:
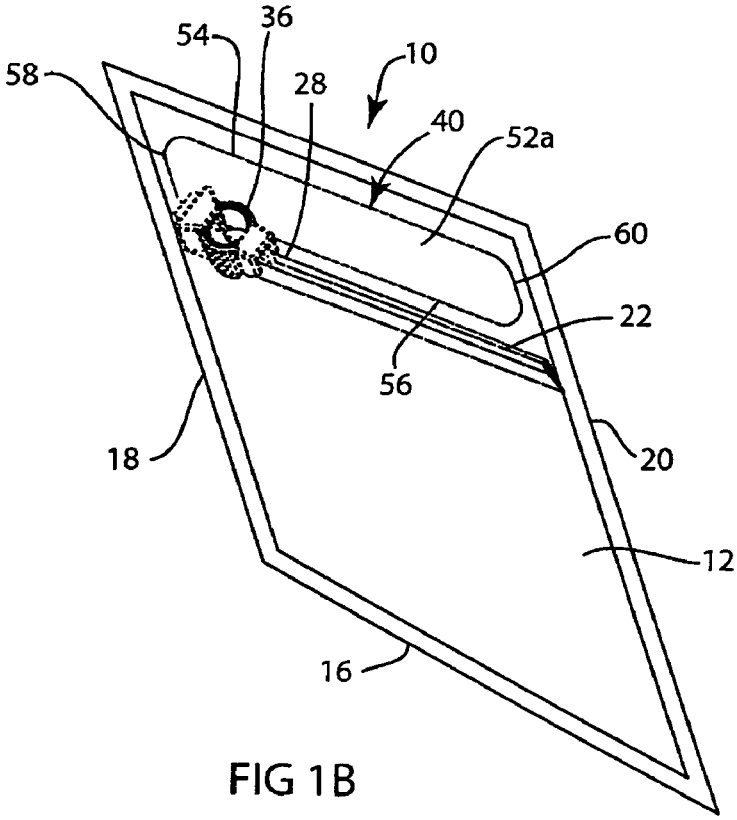
FIG. 1B is an alternative embodiment of FIG. 1A.
Figure 6:
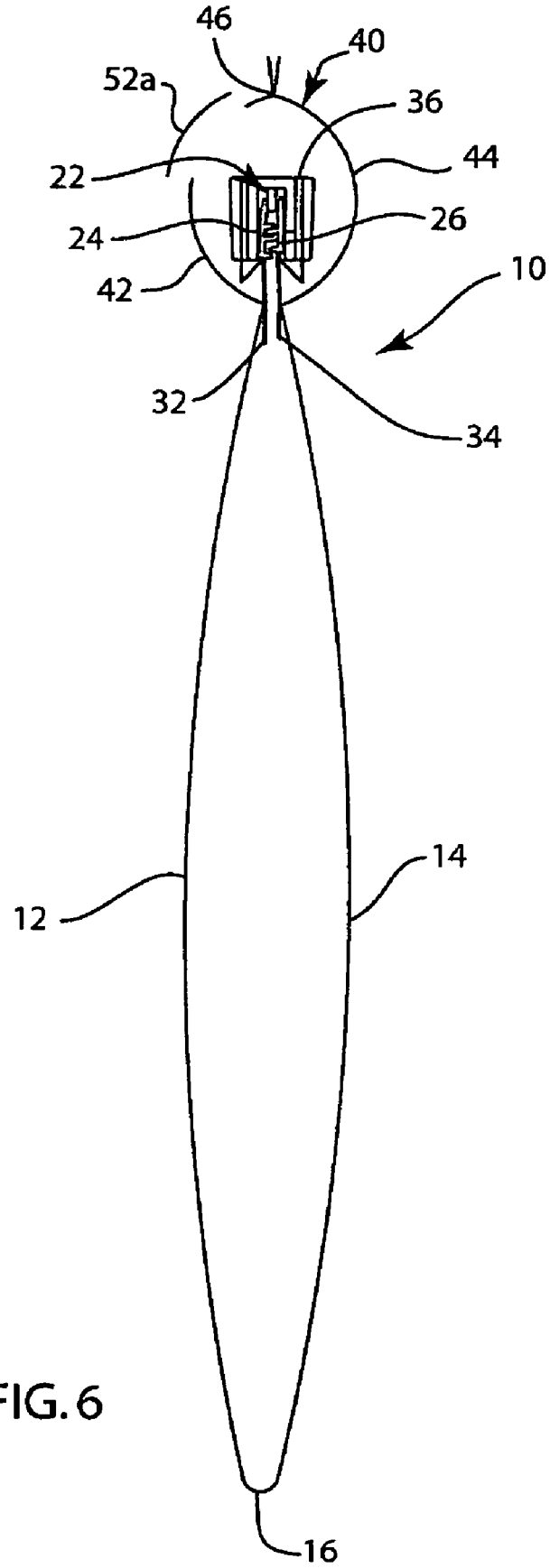
FIG. 6 is a sectional view of FIG. 1B showing the removal of the partial tear-off header strip.

FIGS. 1B and 6 depict an alternative embodiment of FIGS. 1A and 5 wherein a removable strip 52*a* is located on the front portion 42 at an elevation higher than strip 52 and generally above the slider device 36. Details of the attachment and removal of strip 52*a* are identical to those described relative to strip 52. Removal of strip 52*a* allows access to the slider device 36 from an upper window formed in the front portion 42 of the header 40. If desired, the rear portion 44 of header 40 may be formed with hang hole 62 or handle opening 64.

Figure 4:
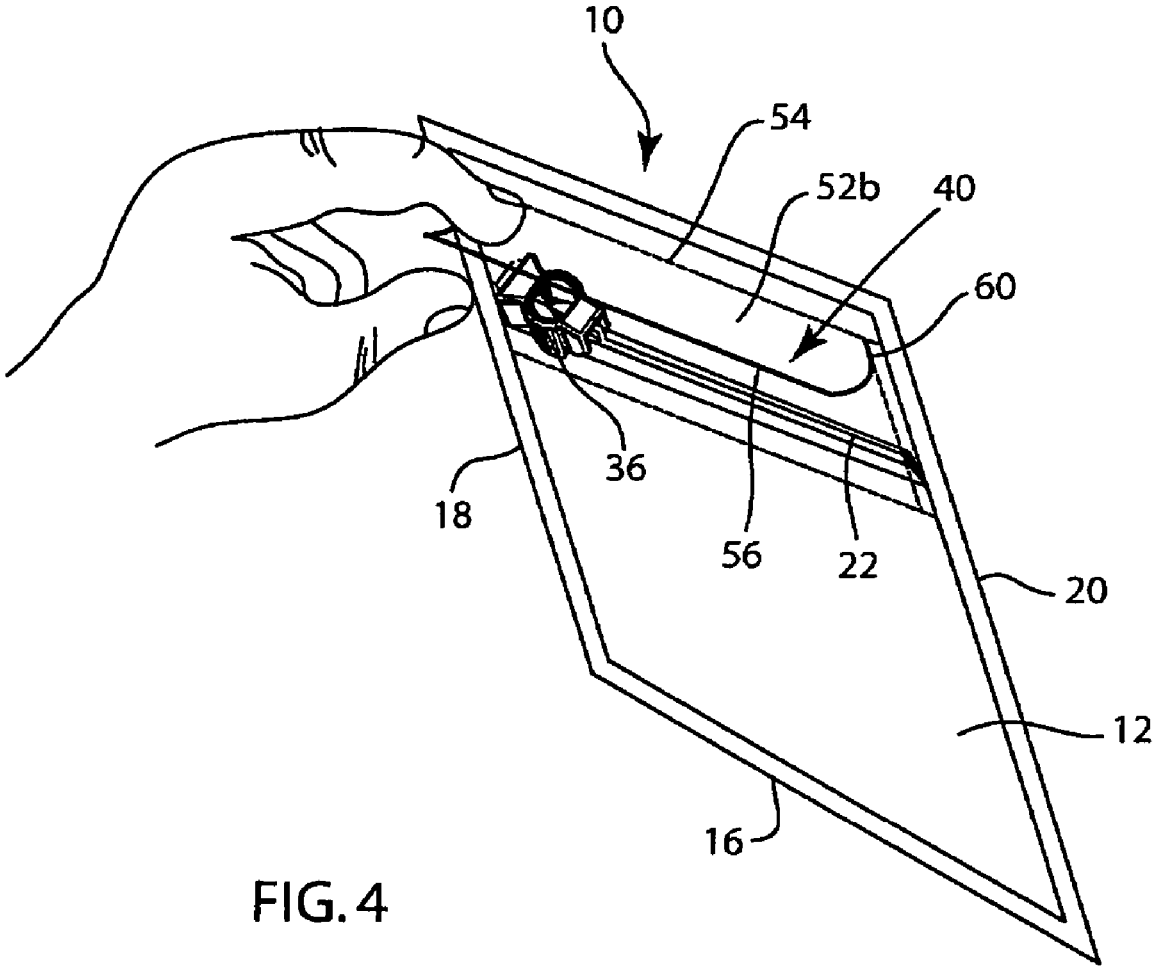
FIG. 4 is a perspective view of another alternative embodiment of FIG. 1A.
Figure 7:
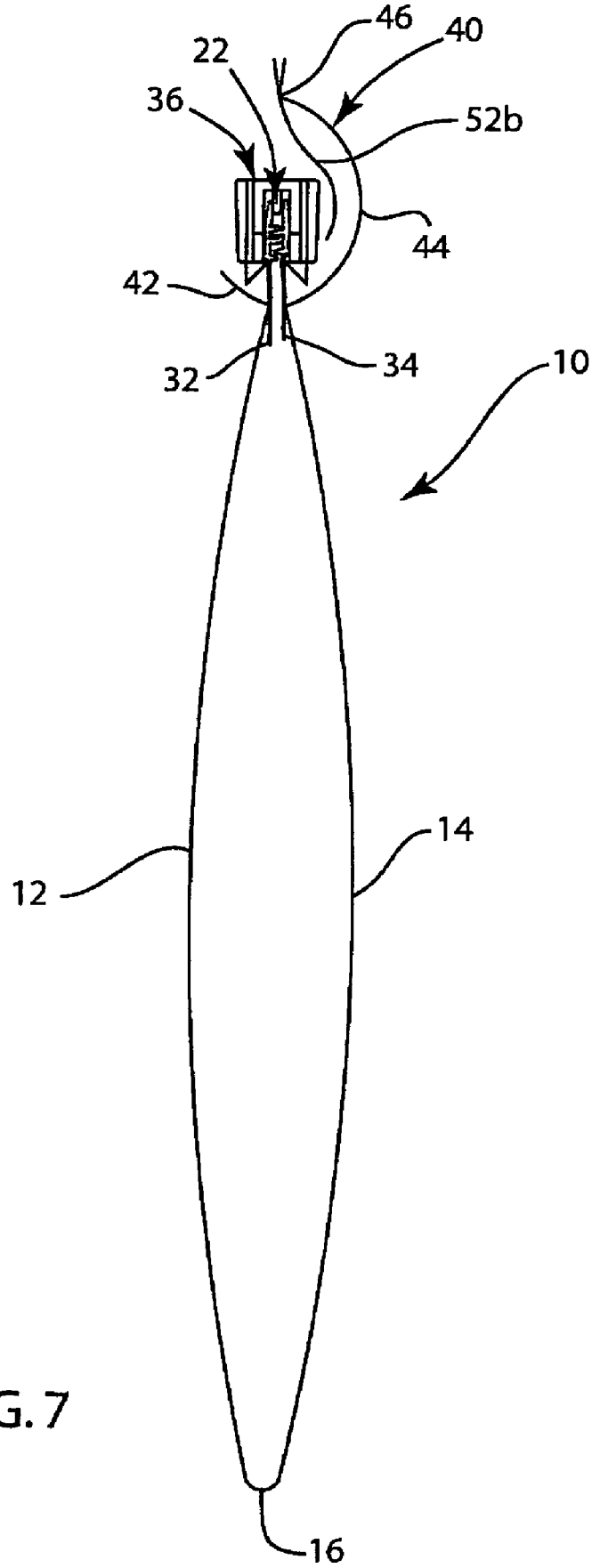
FIG. 7 is a sectional view of FIG. 4 showing one partially severed header portion being tucked between a slider device and another header portion.

FIGS. 4 and 7 show a further alternative embodiment of the tamper-evident header 40. In this version, the front portion 42 of header 40 includes a partially-removable segment identified as strip 52*b* which has upper edge 54 permanently attached along its length and lower edge 56 unattached. Upper edge 42 forms a fixed portion of the partially-removable segment. Opposed side edges 58, 60 are removably connected to the front portion 42 of the header 40 via perforated or scored lines. Opposed side edges 58, 60 form a separable portion of the partially-removable segment. To access slider device 36, a consumer grasps the free lower edge 56, as shown in FIG. 7, and pulls upwardly severing the side edges 58, 60 so as to displace and tuck the strip 52*b* between the rear of the slider device 36 and the rear portion 44 of the header 40. The strip 52*b* remains tucked in this position as the slider device 36 is moved back and forth across the zipper closure 22. Displacement of strip 52*b* allows access to slider device 36 so that the package 10 can be opened and closed.

It should now be appreciated that the present invention provides a reclosable package having a combined zipper closure and slider device with a displaceable header front portion constructed and arranged to enable easier access to the package without having to remove the entire header structure. The present invention also creates a header rear portion which can be formed with a hang hole or handle opening to enhance the display and/or transport capability of the package 10.

Having described the presently preferred embodiments, it is to be understood that the invention may be otherwise embodied within the scope of the appended claims.

What is claimed is:

1. A reclosable package comprising:

first and second side panels, each having an upper edge, opposed side edges and a bottom edge, the opposed side edges and bottom edges being sealed together;

a zipper closure sealed to the first and second side panels along the upper edges thereof, the zipper closure extending from one of the sealed side edges to the other of the sealed side edges;

a slider device operably mounted on the zipper closure for opening and closing the zipper closure; and a tamper-evident header connected to the zipper closure and surrounding the slider device, the tamper-evident header having a front face and a rear face with upper ends connected together above the slider device and lower ends connected together to the zipper closure, the front face including a partially-removable segment comprising a separable portion and a fixed portion:

the separable portion being separable from the front face, thereby allowing access to the slider device;

the fixed portion keeping the partially-removable segment attached to the front face such that the partially-removable segment can be tucked between the slider device and the rear face;

wherein the partially-removable segment has an upper edge permanently connected to the front face of the header, opposite side edges which are perforated and a bottom edge lying free relative to the front face of the header.

2. The reclosable package of claim 1, wherein the segment is a strip extending substantially entirely across the front face between the sealed side edges of the side panels.

3. The reclosable package of claim 1, wherein the segment has one edge which is unattached to the front face of the header.

4. The reclosable package of claim 1, wherein the rear face of the header is formed with an opening used to suspend or carry the package.

5. A method for preventing and enabling access to a reclosable package, the method comprising the steps of:

providing first and second opposed panels connected to each other along respective side edges and bottom edges, a zipper closure being connected to the first and second side panels along upper edges thereof, and a slider device being operably mounted on the zipper closure for permitting opening and closing thereof;

connecting a tamper-evident header to the zipper closure surrounding the slider device for normally preventing access thereto, the tamper-evident header including a front face and a rear face having upper ends joined together above the slider device and lower ends connected to the zipper closure and at least a partially-removable segment comprising a separable portion and a fixed portion:

the separable portion being separable from the front face, thereby allowing access to the slider device;

the fixed portion keeping the partially-removable segment partially attached to the front face such that the partially-removable segment can be tucked between the slider device and the rear face; and, at least partially severing the partially-removable segment from the front face so as to displace the partially severable segment, the partially severable segment remaining attached to the front face via the fixed portion, and inserting the partially-removable segment between the slider device and the rear face, thereby allowing access to the slider device for opening and closing the package.

6. The method of claim 5, wherein the segment is formed in the front face of the header.

7. The method of claim 5, wherein a hole is formed in the rear face of the header to enable hanging or carrying of the package.

* * * * *